US011691252B2

(12) United States Patent
Chen

(10) Patent No.: US 11,691,252 B2
(45) Date of Patent: Jul. 4, 2023

(54) RATCHET DRIVEN SCREWDRIVER WITH BITS STORAGE

(71) Applicant: Yi-Wen Chen, Changhua County (TW)

(72) Inventor: Yi-Wen Chen, Changhua County (TW)

( * ) Notice: Subject to any disclaimer, the term of this patent is extended or adjusted under 35 U.S.C. 154(b) by 276 days.

(21) Appl. No.: 17/145,185

(22) Filed: Jan. 8, 2021

(65) Prior Publication Data

US 2022/0219294 A1 Jul. 14, 2022

(51) Int. Cl.
*B25B 15/04* (2006.01)
*B25B 23/00* (2006.01)
*B25G 1/08* (2006.01)

(52) U.S. Cl.
CPC ..... *B25B 15/04* (2013.01); *B25B 23/0035* (2013.01); *B25G 1/085* (2013.01)

(58) Field of Classification Search
CPC ... B25B 23/0035; B25B 15/04; B25B 13/462; B25B 13/463; B25B 13/468; B25G 1/085
USPC ..... 81/59.1, 438, 439, 490, 177.4
See application file for complete search history.

(56) References Cited

U.S. PATENT DOCUMENTS 5,265,504 A 11/1993 Fruhm
6,305,815 B1 * 10/2001 Lin ..... B25G 1/085 362/120
6,450,067 B1 * 9/2002 Liao ..... B25G 1/085 81/62
6,658,970 B2 * 12/2003 Shiao ..... B25B 13/468 81/62
6,935,211 B2 * 8/2005 Chen ..... B25B 23/0035 81/58.4
8,122,791 B2 2/2012 Klomp
2004/0065177 A1 4/2004 Wannop
2004/0093745 A1 * 5/2004 Liao ..... B23D 51/10 30/329

FOREIGN PATENT DOCUMENTS

TW 201424943 7/2014

* cited by examiner

*Primary Examiner* — Don M Anderson
*Assistant Examiner* — Jason Khalil Hawkins

(57) ABSTRACT

A ratchet driven screwdriver with bits storage has a body. A ratchet driving device has a ratchet, a lever, a ratchet housing, a ratchet spring, two L-shaped ratchets, a steel ball and a compression spring. A bits storage has a spring seat, two torsion springs, a storage tube, an axis column, and a bits box. When replacing the bits, the back cover is pulled to drive the storage tube. Currently, a pressure of the two torsion springs can extend to a tapered end of the axis column to release a vertical force, and the back cover is pulled apart. The two torsion springs extend to the other end of the axis column, and the vertical force can make the bits box pushed to the open state and locked, so that an alternate screwdriver bit can be selected with turning the back cover.

6 Claims, 9 Drawing Sheets

RATCHET DRIVEN SCREWDRIVER WITH BITS STORAGE

TECHNICAL FIELD

The present invention relates to a screwdriver, in particular to a ratchet driven screwdriver with bits storage.

BACKGROUND

In general, conventional ratchet driven screwdrivers are not designed with an integrated ratchet housing and a ratchet set. As a result, it is impossible to provide a large torque of the screwdriver during forward rotation, reverse rotation or locking. If the screwdriver bits box is added to store bits of different types and sizes, the mechanism of the ratchet driven screwdriver should be more complicated.

Therefore, the ratchet driven screwdriver with modular design and easy disassembly design can facilitate assembly and replacement of modules for maintenance, and can also reduce the risk of assembly.

SUMMARY

An objective of the present invention is to provide a ratchet driven screwdriver with bits storage. The ratchet driven screwdriver with bits storage of the present invention selectively activates the clockwise and counterclockwise ratchet operation, or locks the ratchet.

The present invention achieves the above-indicated objective by providing a ratchet driven screwdriver with bits storage. The ratchet driven screwdriver with bits storage includes a screwdriver body, a ratchet driving device and a bits storage. The screwdriver body has a first screwdriver bit, a center rod, a steering wheel housing, a hollow handle and a back cover. The ratchet driving device is disposed in the steering wheel housing, and the ratchet driving device has a ratchet, a lever, a ratchet housing, a ratchet spring, two L-shaped ratchets, a steel ball and a compression spring. The bits storage is disposed in the hollow handle, and the bits storage has a spring seat, two torsion springs, a storage tube, an axis column, a bits box and a second screwdriver bit.

In a preferred embodiment, when the first screwdriver bit is to be replaced with the second screwdriver bit, the back cover is pulled to drive the storage tube, and a pressure of the two torsion springs can extend to a tapered end of the axis column to release a vertical force, and the back cover is pulled apart and the two torsion springs extend to the other end of the axis column, and the vertical force can make the bits box pushed to the open state and locked, so that the second screwdriver bit can be selected with turning the back cover.

In a preferred embodiment, when the steering wheel housing is rotated clockwise or counterclockwise, a positioning groove of the steering wheel housing can drive the lever, and the lever also drives the L-shaped ratchets to overcome a spring force of the ratchet spring, which can pull one side of the two L-shaped ratchets away from the ratchet, so that the two-way locking of the ratchet can be released and the ratchet rotates clockwise or counterclockwise.

DETAILED DESCRIPTION

Figure 1:
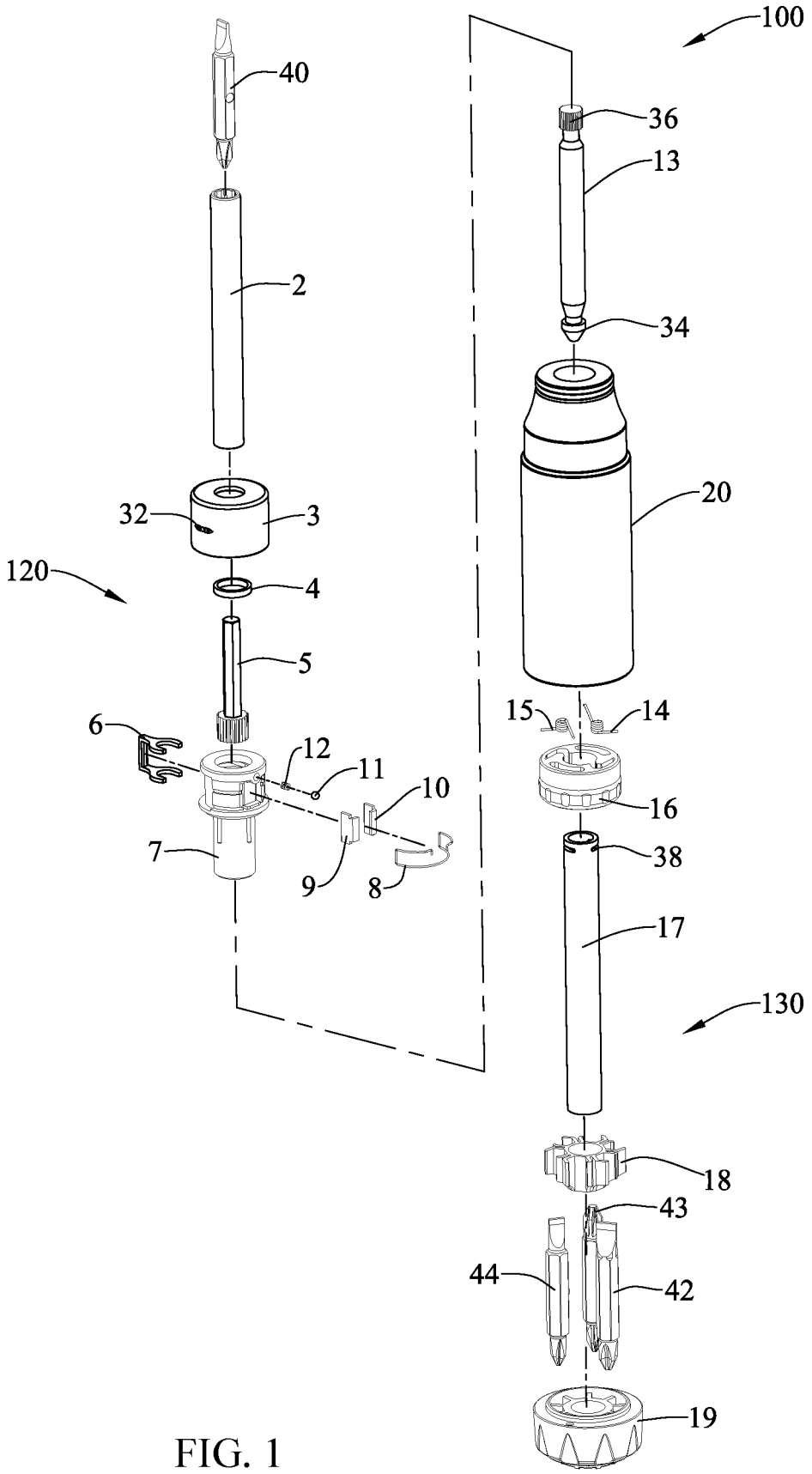
FIG. 1 is a perspective exploded view of the ratchet driven screwdriver with bits storage of the present invention.
Figure 2:
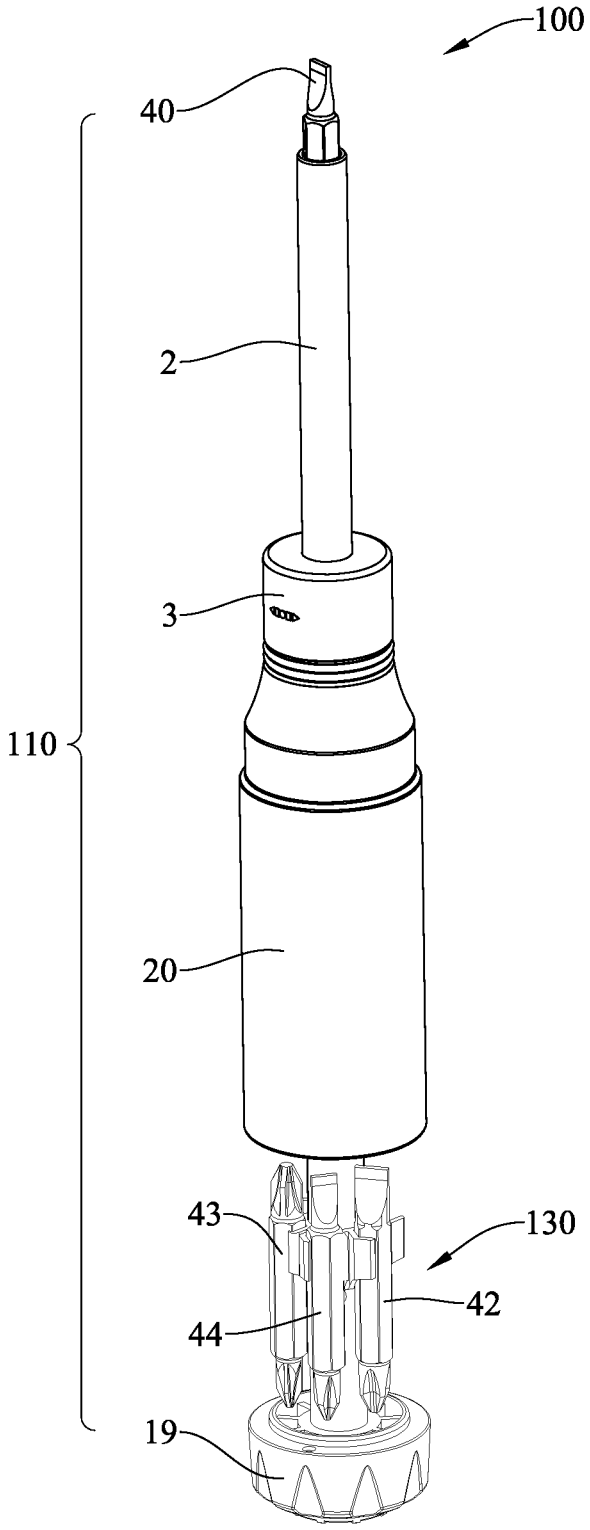
FIG. 2 is a perspective view of the ratchet driven screwdriver with bits storage of the present invention.

The ratchet driven screwdriver with bits storage of the present invention selectively activates the clockwise and counterclockwise ratchet operation, or locks the ratchet. FIG. 1 is a perspective exploded view of the ratchet driven screwdriver with bits storage of the present invention, and FIG. 2 is a perspective view of the ratchet driven screwdriver with bits storage of the present invention. As shown in FIG. 1 and FIG. 2, a ratchet driven screwdriver with bits storage 100 has a screwdriver body 110, a ratchet driving device 120 and a bits storage 130.

The screwdriver body 110 has a first screwdriver bit 40, a center rod 2, a steering wheel housing 3, a hollow handle 20 and a back cover 19. Two ends of the first screwdriver bit 40 have a flat screwdriver bit and a cross screwdriver bit. The above-mentioned first screwdriver bit 40 is just an example. A shape of each the two ends of the first screwdriver bit 40 can be triangular, hexagonal, star-shaped or other shapes.

The ratchet driving device 120 is disposed in the steering wheel housing 3. The ratchet driving device 120 has a bushing 4, a ratchet 5, a lever 6, a ratchet housing 7, a ratchet spring 8, two L-shaped ratchets 9 and 10, a steel ball 11 and a compression spring 12.

The bits storage 130 is disposed in the hollow handle 20. The bits storage 130 has a spring seat 16, two torsion springs 14 and 15, a storage tube 17, an axis column 13, a bits box 18, a second screwdriver 42, a third bit screwdriver bit 43 and a fourth screwdriver bit 44. The two ends of each the second screwdriver 42, the third bit screwdriver bit 43 or the fourth screwdriver bit 44 have a flat screwdriver bit and a cross screwdriver bit. The above-mentioned second screwdriver bit 42, third screwdriver bit 43, and fourth screwdriver bit 44 are just examples. The shape of the bit can be triangular, hexagonal, star-shaped or other shapes. There is no limit to the number of spare screwdriver bits. The variety of the spare screwdriver bits is not limited to the shape of both ends, most of which are single bit, depending on the design of the bits box 18 and the center rod 2 to contain the screwdriver bits.

When the steering wheel housing 3 is rotated clockwise or counterclockwise, a positioning groove 32 of the steering wheel housing 3 can drive the lever 6, and the lever 6 also drives the two L-shaped ratchets 9 and 10 to overcome a spring force of the ratchet spring 8, which can pull one side of the two L-shaped ratchets 9 and 10 away from the ratchet 5. In this way, the two-way locking of the ratchet 5 can be released, so that the ratchet 5 rotates clockwise or counterclockwise. In addition to, the positioning groove 32 is disposed inside the steering wheel housing 3.

When the steering wheel housing 3 is not rotated, the ratchet wheel 5 is locked. Since the ratchet housing 7 is of one-piece design, it can provide greater torque for the screwdriver. The screwdriver of the present invention adopts the design of an integrated ratchet housing 7 and a set of the ratchet wheel 5, which can provide a larger torque of the screwdriver when rotating forward, backward or locked. In addition, the steering wheel housing 3 is positioned by the positioning groove 32 of the steering wheel housing 3 in cooperation with the steel ball 11 and the compression spring 12.

When replacing the screwdriver bits, the back cover 19 is pulled to drive the storage tube 17. Currently, a pressure of the two torsion springs 14 and 15 can extend to a tapered end 34 of the axis column 13 to release a vertical force, and the back cover 19 is pulled apart. The two torsion springs 14 and 15 extend to the other end 36 of the axis column 13, and the vertical force can make the bits box 18 pushed to the open state and locked, so that an alternate screwdriver bit can be selected with turning the back cover 19.

When the bits box 18 is inside the hollow handle 20, the two torsion springs 14 and 15 of the spring seat 16 are twisted, and one end of the two torsion springs 14 and 15 is restricted to a recess 38 of the storage tube 17. And, a pressure is applied to the tapered end 34 of the axis column 34, so that the bits box 18 cannot be detached, and the back cover 19 can still be rotated in use.

Figure 3:
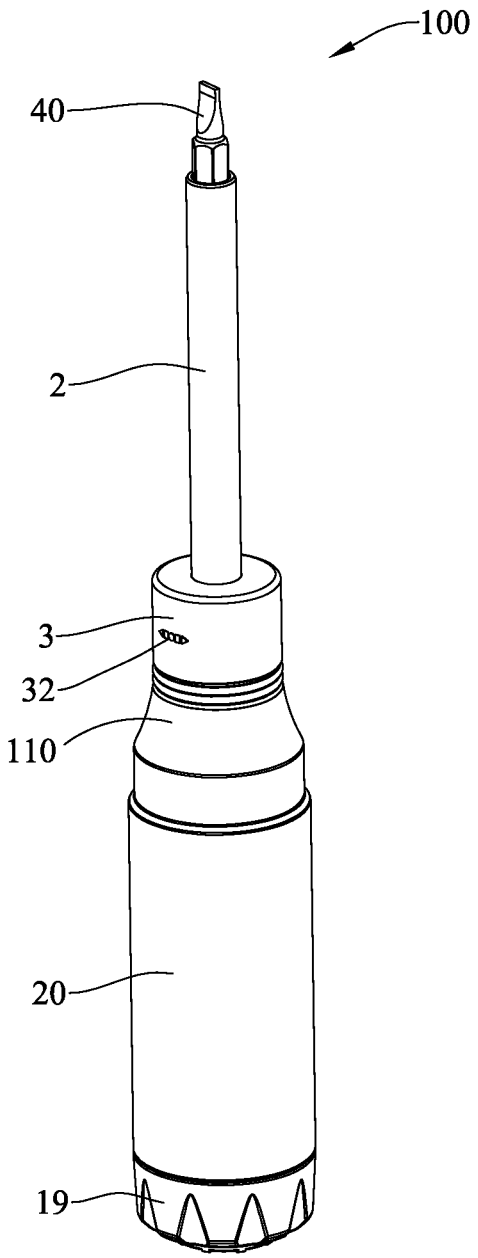
FIG. 3 is a perspective view of the bits storage of the ratchet driven screwdriver according to the present invention when it is closed.

FIG. 3 is a perspective view of the bits storage of the ratchet driven screwdriver according to the present invention when it is closed. As shown in FIG. 3, the bits storage 130 is housed in the hollow handle 20.

Figure 4A:
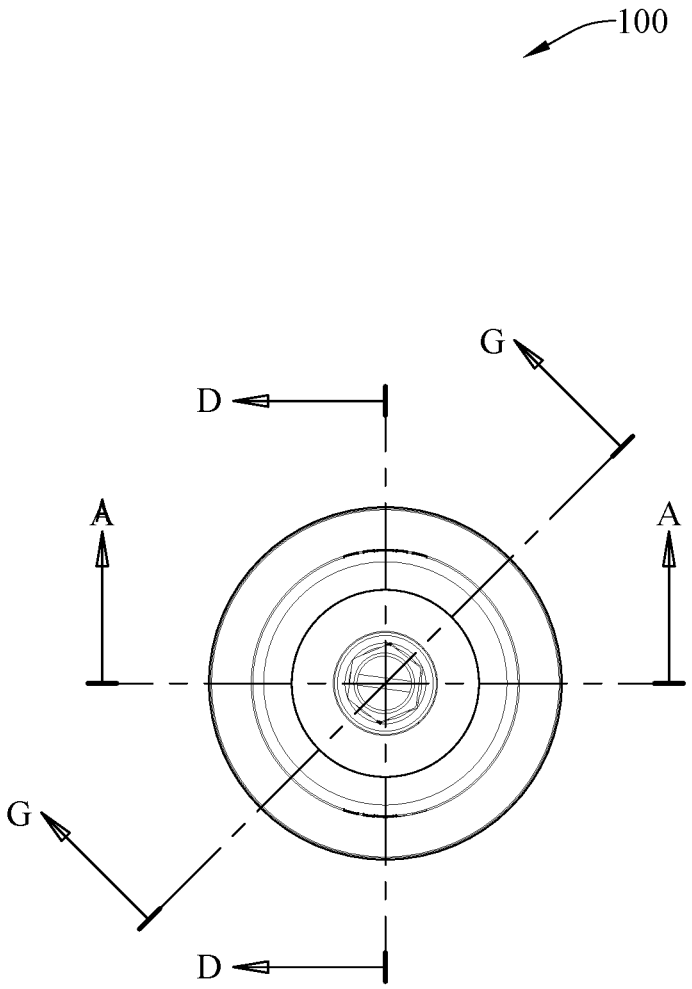
FIGS. 4A-4D are longitudinal cross-sectional views of the ratchet driven screwdriver with bits storage according to the present invention.
Figure 4B:
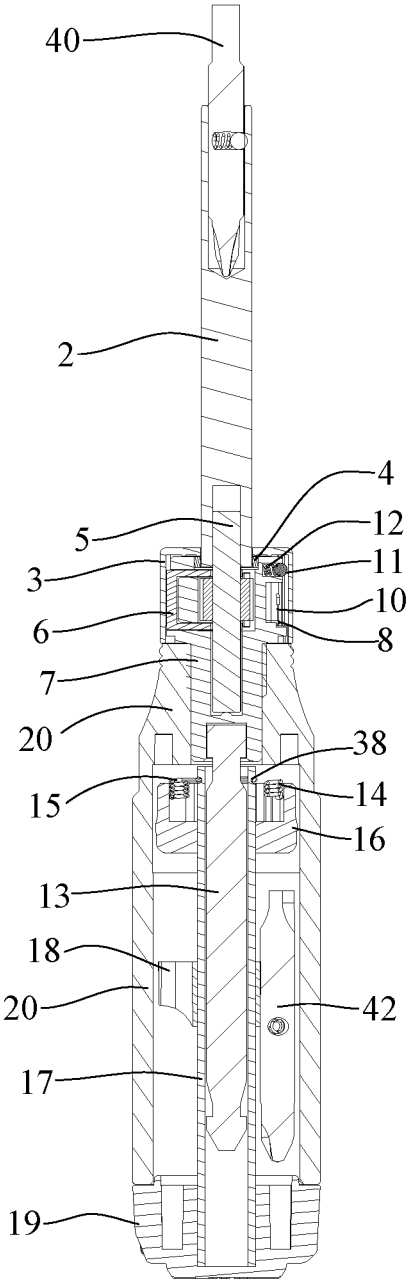
Figure 4C:
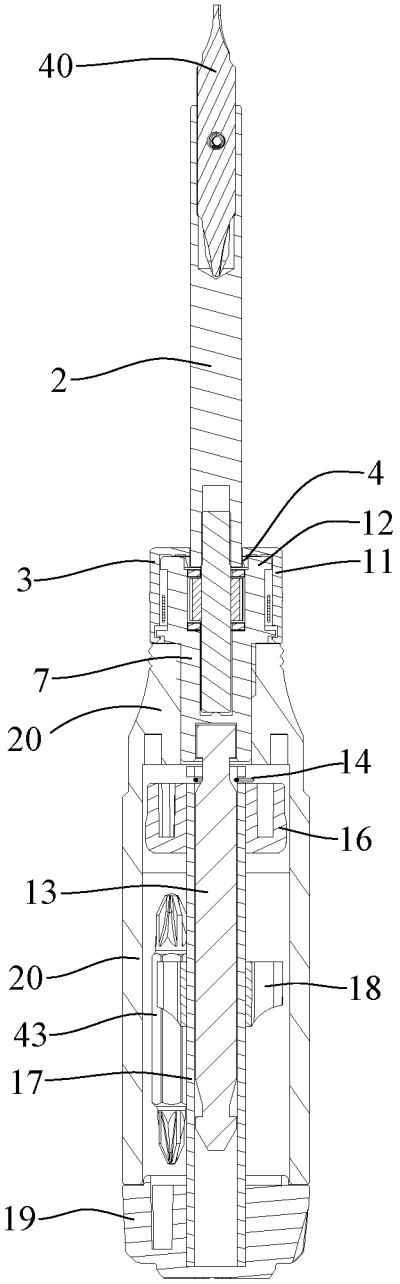
Figure 4D:
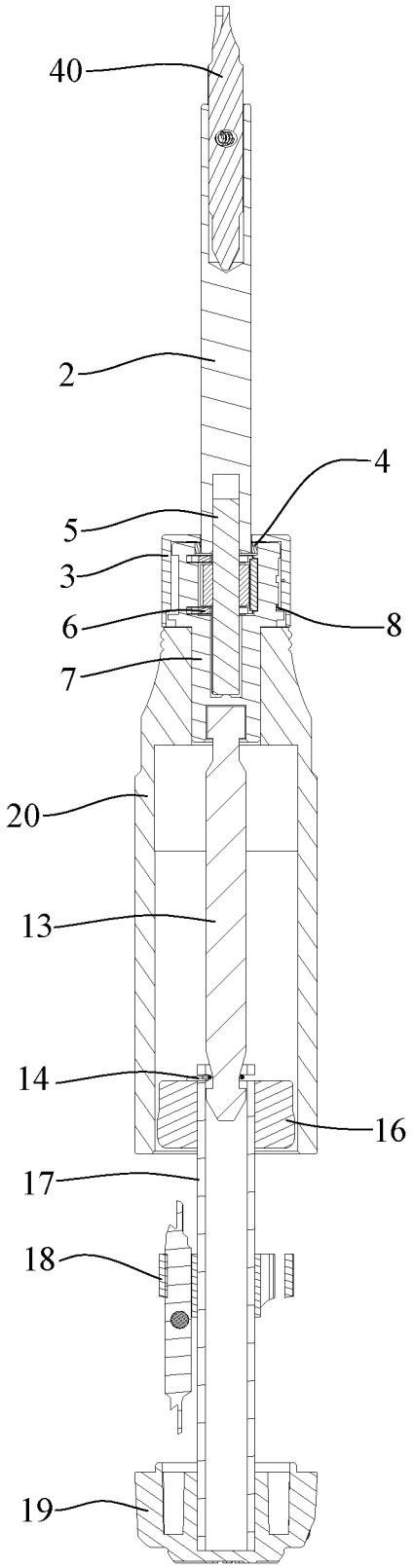

FIGS. 4A-4D are longitudinal cross-sectional views of the ratchet driven screwdriver with bits storage according to the present invention. FIG. 4A is the longitudinal cross-sectional position of A-A, D-D and G-G of the ratchet driven screwdriver with bits storage according to the present invention. FIG. 4B is an A-A cross-sectional view of the ratchet driven screwdriver with bits storage according to the present invention. FIG. 4C is a D-D cross-sectional view of the ratchet driven screwdriver with bits storage according to the present invention. FIG. 4D is a G-G cross-sectional view of the ratchet driven screwdriver with bits storage according to the present invention.

Figure 5A:
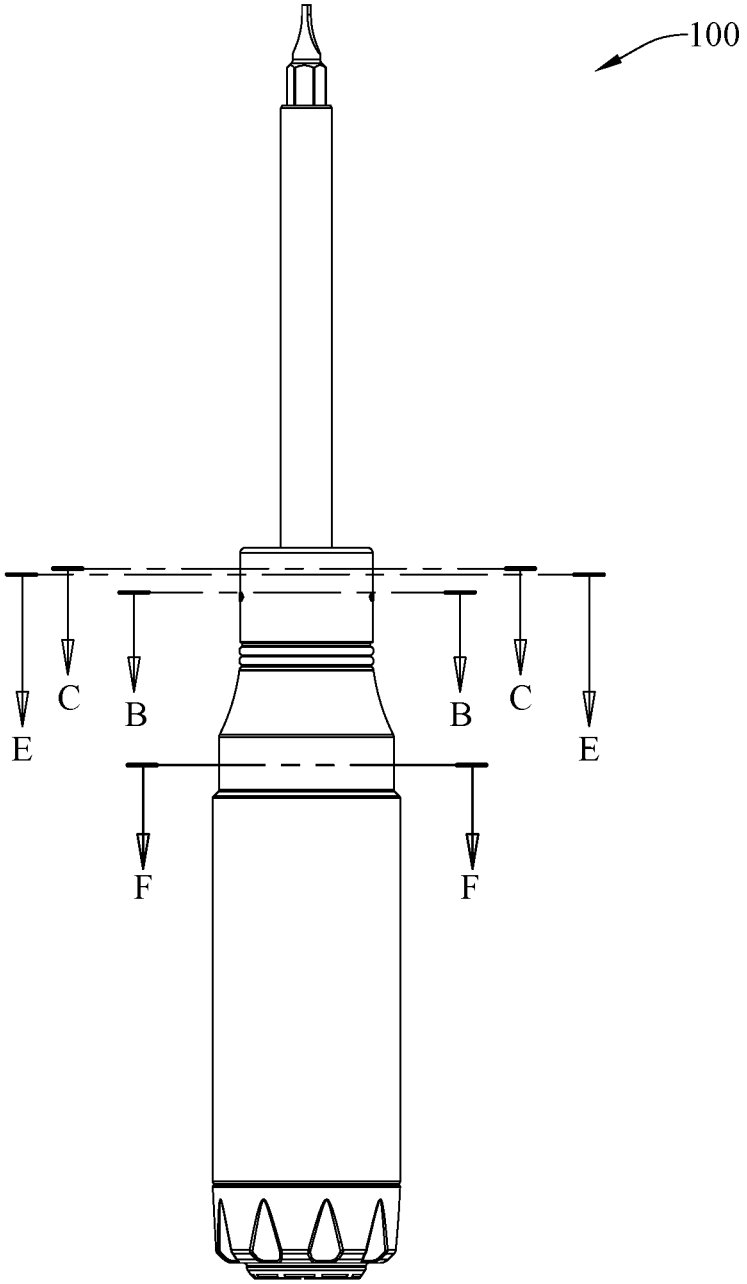
FIGS. 5A-5H are transverse cross-sectional views of the ratchet driven screwdriver with bits storage according to the present invention.
Figure 5B:
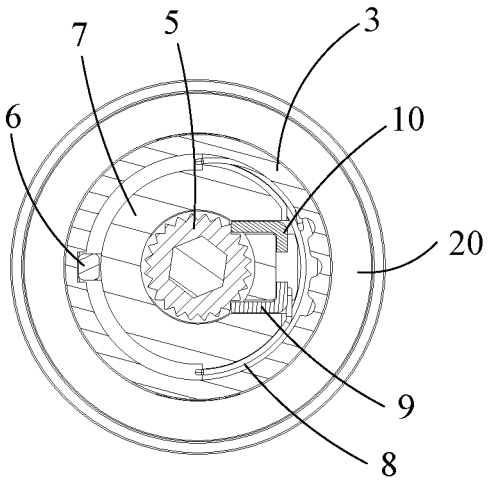
Figure 5C:
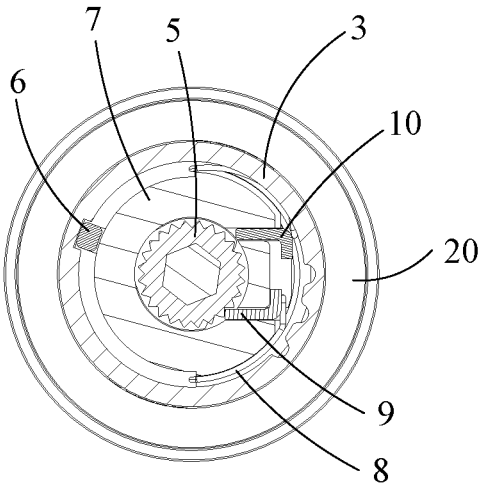
Figure 5D:
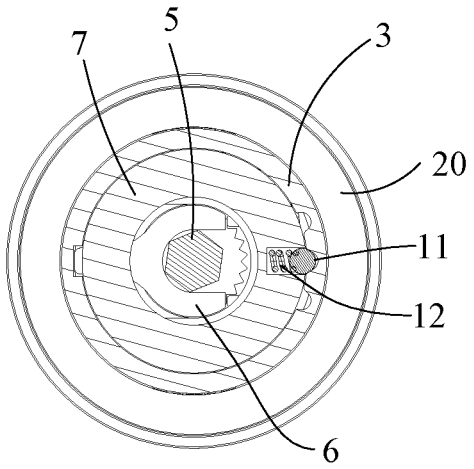
Figure 5E:
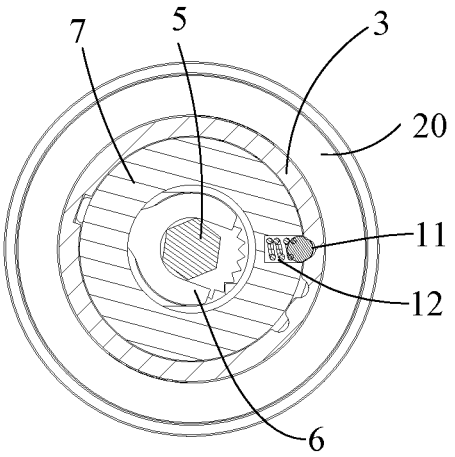
Figure 5F:
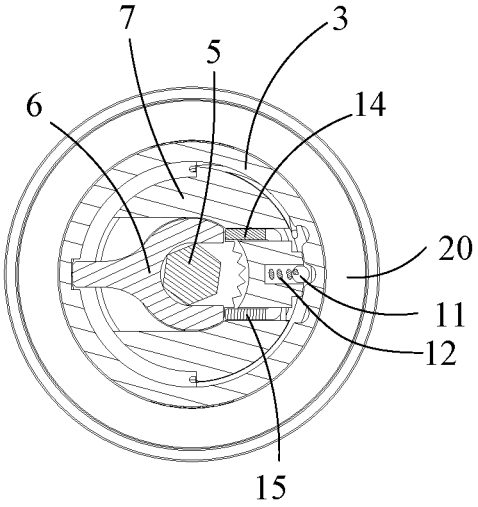
Figure 5G:
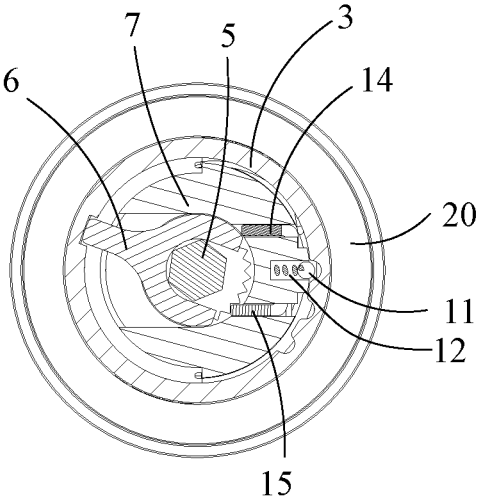
Figure 5H:
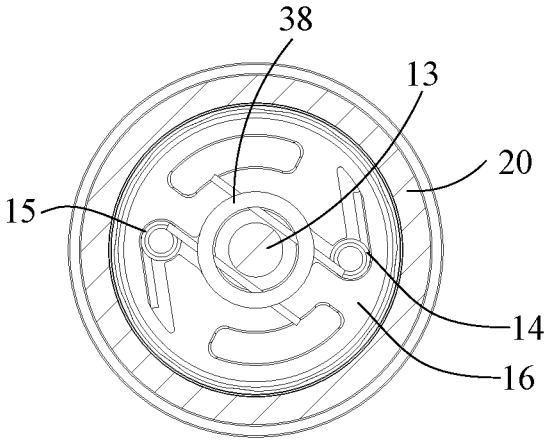

FIGS. 5A-5H are transverse cross-sectional views of the ratchet driven screwdriver with bits storage according to the present invention. FIG. 5A is the transverse cross-sectional position of B-B, C-C, E-E and F-F of the ratchet driven screwdriver with bits storage according to the present invention. B-B is the cross-sectional position of the L-shaped ratchet 9, C-C is the cross-sectional position of the steel ball 11, and E-E is the cross-sectional position of the lever 6. FIG. 5B is a B-B cross-sectional view of the ratchet driven screwdriver with bits storage according to the present invention when the ratchet wheel is locked, and FIG. 5B is the cross-sectional position of the L-shaped ratchet 9 when the steering wheel housing 3 is not rotating and the ratchet wheel 5 is locked. FIG. 5C is a B-B cross-sectional view of the ratchet driven screwdriver with bits storage according to the present invention, and FIG. 5C is the cross-sectional position of the L-shaped ratchet 9 when the steering wheel housing 3 is rotating. FIG. 5D is a C-C cross-sectional view of the ratchet driven screwdriver with bits storage according to the present invention when the ratchet wheel is locked, and FIG. 5D is the cross-sectional position of the steel ball 11 when the steering wheel housing 3 is not rotating and the ratchet wheel 5 is locked. FIG. 5E is the C-C cross-sectional view of the ratchet driven screwdriver with bits storage according to the present invention, and FIG. 5E is the cross-sectional position of the steel ball 11 when the steering wheel housing 3 is rotating. FIG. 5F is an E-E sectional view of the ratchet driven screwdriver with bits storage according to the present invention when the ratchet wheel is locked, and FIG. 5F is the cross-sectional position of the lever 6 when the steering wheel housing 3 is not rotating but the ratchet wheel 5 is locked. FIG. 5G is an E-E cross-sectional view of the ratchet driven screwdriver with bits storage according to the present invention, and FIG. 5G is a cross-sectional position of the lever 6 when the steering wheel housing 3 is rotating. FIG. 5H is an F-F cross-sectional view of the ratchet driven screwdriver with bits storage according to the present invention, and FIG. 5H is a cross-sectional position of the two torsion springs 14 and 15.

In summary, a notch storage is used to store various screwdriver bits, and the bits box 18 is enclosed inside the hollow handle 20 of the screwdriver 100. When the back cover 19 of the hollow handle 20 is pulled, the bits box 18 is pulled out along the axis column 13 of the screwdriver 100. The screwdriver bits are stored in the bits storage 130 and are located on the circumference of the storage tube 17 reciprocating relative to the screwdriver 100. When the bits box 18 is completely removed, the screwdriver bits can be easily viewed, and they can be removed or replaced separately from the bits box 18 with a simple radial force.

Compared to a conventional ratchet driven screwdriver, the present invention has several advantages:

1. The present invention uses a modular design, which can be assembled into semi-finished modules first, and then related modules can be placed in accordance with shipping requirements. Each module of the present invention has a replaceable module for maintenance.

2. The invention uses an easy-to-disassemble design, easy assembly can reduce the risk of assembly press-fitting, and the design of the ratchet driven device can effectively increase the torque by 15-20%.

What is claimed is:

1. A ratchet driven screwdriver with bits storage, comprising:

a screwdriver body, having a first screwdriver bit, a center rod, a steering wheel housing, a hollow handle and a back cover;

a ratchet driving device, disposed in the steering wheel housing, the ratchet driving device having a ratchet, a lever, a ratchet housing, a ratchet spring, two L-shaped ratchets, a steel ball and a compression spring; and a bits storage having a spring seat, two torsion springs, a storage tube, an axis column, a bits box and a second screwdriver bit, wherein the back cover is fixed to the storage tube;

wherein when the ratchet driven screwdriver is in a closed state, ends of the two torsion springs extend to a first end of the axis column, and when the back cover is pulled in an axial direction, the storage tube is drawn out of the hollow handle to an open state of the ratchet driven screwdriver in which the two torsion springs extend to a second end of the axis column to lock the storage tube in place with the bits box exposed, wherein the back cover is rotatable in the open state; and wherein when the ratchet driven screwdriver is in the closed state, the bits box is disposed inside the hollow handle, the two torsion springs of the spring seat are twisted, the ends of the two torsion springs are respectively restricted to a recess of the storage tube, and a pressure is applied to the first end of the axis column such that the storage tube is held in place, wherein the back cover is rotatable in the closed state.

2. The ratchet driven screwdriver with bits storage as recited in claim 1, wherein when the steering wheel housing is rotated clockwise or counterclockwise, a positioning groove of the steering wheel housing drives the lever, and the lever also drives the two L-shaped ratchets to overcome a spring force of the ratchet spring, which can pull one side of the two L-shaped ratchets away from the ratchet, so that the two-way locking of the ratchet can be released and the ratchet rotates clockwise or counterclockwise.

3. A ratchet driven screwdriver with bits storage, comprising:

a screwdriver body, having a first screwdriver bit, a center rod, a steering wheel housing, a hollow handle and a back cover;

a ratchet driving device, disposed in the steering wheel housing, the ratchet driving device having a ratchet, a lever, a ratchet housing, a ratchet spring, two L-shaped ratchets, a steel ball and a compression spring; and a bits storage having a spring seat, two torsion springs, a storage tube, an axis column, a bits box and a second screwdriver bit;

wherein when the steering wheel housing is rotated clockwise or counterclockwise, a positioning groove of the steering wheel housing drives the lever, and the lever also drives the L-shaped ratchets to overcome a spring force of the ratchet spring, which pulls one side of the two L-shaped ratchets away from the ratchet, such that the two-way locking of the ratchet is released and the ratchet is rotatable clockwise and counterclockwise; and when the ratchet driven screwdriver is in a closed state, the bits box is disposed inside the hollow handle, the two torsion springs of the spring seat are twisted, and ends of the two torsion springs are respectively restricted to a recess of the storage tube, and a pressure is applied to the tapered end of the axis column such that the storage tube is held in place, wherein the back cover is rotatable in the closed state.

4. The ratchet driven screwdriver with bits storage as recited in claim 3, wherein when the ratchet driven screwdriver is in a closed state, the ends of the two torsion springs extend to a first end of the axis column, and when the back cover is pulled in an axial direction, the storage tube is drawn out of the hollow handle to an open state of the ratchet driven screwdriver in which the two torsion springs extend to a second end of the axis column to lock the storage tube in place with the bits box exposed, wherein the back cover is rotatable in the open state.

5. The ratchet driven screwdriver with bits storage as recited in claim 1, wherein the axis column is fixed relative to the hollow handle and the hollow tube is slidably fit onto the axis column.

6. The ratchet driven screwdriver with bits storage as recited in claim 3, wherein the axis column is fixed relative to the hollow handle and the hollow tube is slidably fit onto the axis column.

* * * * *